US009837708B2

(12) United States Patent
Yoshino et al.

(10) Patent No.: US 9,837,708 B2
(45) **Date of Patent: *Dec. 5, 2017**

(54) COBRA ANTENNA

(75) Inventors: Yoshitaka Yoshino, Tokyo (JP); Satoru Tsuboi, Kanagawa (JP)

(73) Assignee: Sony Corporation, Tokyo (JP)

( * ) Notice: Subject to any disclaimer, the term of this patent is extended or adjusted under 35 U.S.C. 154(b) by 374 days.

This patent is subject to a terminal disclaimer.

(21) Appl. No.: 13/635,933

(22) PCT Filed: Mar. 14, 2011

(86) PCT No.: PCT/JP2011/055924

§ 371 (c)(1),
(2), (4) Date: Sep. 19, 2012

(87) PCT Pub. No.: WO2011/118436

PCT Pub. Date: Sep. 29, 2011

(65) Prior Publication Data

US 2013/0009835 A1 Jan. 10, 2013

(30) Foreign Application Priority Data

Mar. 26, 2010 (JP) ..... 2010-071218

(51) Int. Cl.
*H01Q 9/16* (2006.01)
*H01Q 1/32* (2006.01)
*H01Q 9/30* (2006.01)

(52) U.S. Cl.
CPC ..... *H01Q 1/3291* (2013.01); *H01Q 9/16* (2013.01); *H01Q 9/30* (2013.01)

(58) Field of Classification Search
CPC ..... H01Q 9/16; H01Q 9/30; H01Q 1/3291; H01Q 7/08; H01Q 21/062
(Continued)

(56) References Cited

U.S. PATENT DOCUMENTS 3,534,371 A * 10/1970 Seavey ..... H01Q 1/427 343/722
4,730,195 A * 3/1988 Phillips ..... H01Q 9/18 343/727
(Continued)

FOREIGN PATENT DOCUMENTS

JP 61-026794 U 2/1986
JP 63-033205 U 3/1988
(Continued)

OTHER PUBLICATIONS

Japanese Office Action dated Mar. 4, 2014 in connection with Japanese Application No. 2010071218, and English translation thereof.
(Continued)

*Primary Examiner* — Dameon E Levi
*Assistant Examiner* — David Lotter
(74) *Attorney, Agent, or Firm* — Chip Law Group

(57) ABSTRACT

The present invention relates to a small cobra antenna that has a high performance as an antenna gain, and minimizes the effect of the length of the coaxial wire.
An antenna element and a coaxial wire are connected to a junction that is a feeding point. The antenna element has a length corresponding to the frequency of a broadcast wave to be received. Further, a ferrite core is positioned at a location a length identical to the length of the antenna element away from the junction. The coaxial wire is wound around the ferrite core about once to three times. A high frequency interrupting part for interrupting the high-frequency current from the coaxial wire is provided at the front side of a connecter of a receiver to which the other end of the coaxial wire is connected.

4 Claims, 5 Drawing Sheets

(58) Field of Classification Search
USPC ..... 343/787, 791, 792
See application file for complete search history.

(56) References Cited

U.S. PATENT DOCUMENTS

| | | | | |
|---|---|---|---|---|
| 8,593,363 | B2 * | 11/2013 | McLean et al. | 343/792 |
| 2008/0143628 | A1 | 6/2008 | Kitada et al. | |
| 2012/0194401 | A1 * | 8/2012 | McLean et al. | 343/792 |
| 2012/0274529 | A1 * | 11/2012 | Yoshino et al. | 343/791 |
| 2013/0050042 | A1 * | 2/2013 | Yoshino et al. | 343/787 |

FOREIGN PATENT DOCUMENTS

| | | | |
|---|---|---|---|
| JP | 2002-517924 | A | 5/1998 |
| WO | WO 2007/017959 | A1 | 2/2007 |

OTHER PUBLICATIONS

[No Author Listed] Ham Radio Series. Chapter on Antenna: Wire Antenna. 2003;pp. 82-93.
[No Author Listed] Ham Radio Series. Chapter on Antenna: Wire Antenna. 2003;pp. 84-85.

* cited by examiner

PRIOR ART

PRIOR ART

COBRA ANTENNA

TECHNICAL FIELD

The present invention relates to a cobra antenna that can be used as an antenna for a wide frequency band ranging from an FM band to a UHF band and that can be implemented with a simple structure.

BACKGROUND ART

Various forms of antennas have conventionally been used as an antenna for receiving various broadcast waves such as television broadcast or FM broadcast. For example, a dipole antenna or a Yagi-Uda antenna is often used for receiving television broadcast and FM broadcast.

On the other hand, the various broadcast waves have increasingly being received in a room, in a car or during travel on foot. The antenna used in such cases needs to be easily handled, for example, for assembly or installation.

Such an easily-assembled or easily-handled antenna is typified by a dipole antenna that is implemented by the antenna elements that are simply structured. A cobra antenna is known as an embodiment of the dipole antenna. The cobra antenna is used with some turns of a coaxial wire around a ferrite core (for example, Non-patent Document 1).

FIG. 5 is a view for showing an exemplary cobra antenna that has been produced by modifying a dipole antenna. As shown in FIG. 5, a cobra antenna 100 includes a central conductor (core wire) 300 and a ferrite core 400. On the assumption that the radio wave to be received has a wavelength of $\lambda$, the central conductor 300 is $\lambda/4$ in length and is connected, as an upper element, on a feeding point 200. The ferrite core 400 is provided under and $\lambda/4$ away from the feeding point 200. A coaxial cable (coaxial wire) 500 is wound around the ferrite core 400. Although the coaxial cable 500 is wound 3 times in FIG. 5, the number of turning (the number of winding) does not necessarily need to be three times. The number may be once or twice.

When the coaxial wire is wound around the ferrite core 400 three times or more, the impedance tends to drastically decrease regardless of the size of the ferrite over about the frequency of 100 MHz. For example, it has been reported that, when the number of winding is once, the impedance of the antenna tends to increase even though the frequency exceeds 100 MHz; however, when the number of winding is three times, the impedance drastically decreases.

In the cobra antenna shown in FIG. 5, a choke coil is formed by a ferrite core 300 and the coaxial cable 500 wound around the ferrite core. The choke coil separates a feeder part below the ferrite core 400 so that a $\lambda/4$ dipole antenna can easily be formed. An egg-shaped glass or the like is attached to the upper core wire 300 of the dipole antenna for insulation so that the antenna can be hung from a tree branch or a wooden frame. This can facilitate the installation of an antenna. A cobra antenna structured in such a manner can also be applied to an antenna of a car-mounted mobile device.

CITATION LIST

Non-Patent Document

Non-patent Document 1: Chapter 1 ANTENA NO KISO, p. 84 in "WIRE ANTENNA" edited by CQ ham radio HENSHU BU

SUMMARY OF THE INVENTION

Problems to be Solved by the Invention

However, when the cobra antenna shown in FIG. 5 is used as an antenna for a wide frequency band ranging from an FM band to a UHF band, an interference of radio waves sometimes occurs depending on the length of the coaxial cable 500 from the ferrite core 400 to a receiver. In other words, there is a problem about radio wave interference in that the high-frequency current received by the upper part of the coaxial cable 500 leaks into the lower part of the coaxial cable 500. The upper part extends from the ferrite core 400 to the feeding point 200. The lower part extends from the ferrite core 400 and is connected to the receiver. The leakage of the high-frequency current is considered to occur due to the impedance mismatch between the upper side and the lower side across the ferrite core 400. There is a disadvantage in that the leakage causes the gain characteristics as an antenna to become bad.

The occurrence of the leakage of the high-frequency current depends on the length of the coaxial cable 500 from the ferrite core 400 to the point connected to the receiver. Thus the occurrence becomes a strict limitation when the length of the part of the coaxial cable 500 is determined. In other words, in a conventional cobra antenna 100, the length of the coaxial cable 500 from the ferrite core 400 to the receiver cannot freely be determined. It is considered that the interference due to the high-frequency current occurs because the cobra antenna 100 uses the outer sheath of the coaxial cable 500 as an antenna. Thus, there is a problem in that the required performance cannot be obtained when the cobra antenna 100 is connected to a connector of the receiver without modification.

The present invention has been made in light of the foregoing problems, and an object of the present invention is to provide a small cobra antenna that can be used as an antenna for a wide frequency band ranging from an FM band to a UHF band, and has a high performance as an antenna. The cobra antenna also minimizes the limitation on the length of the coaxial wire.

Solutions to Problems

To solve the above-mentioned problems and achieve the object of the present invention, the cobra antenna of the present invention includes a junction constituting the feeding point. An antenna element is electrically connected to one terminal of the junction. The antenna element has a length corresponding to the frequency of the broadcast wave to be received. A coaxial wire is connected to the other terminal of the junction. A ferrite core is positioned at a location a length identical to the length of the antenna element away from the other terminal of the junction connected to the coaxial wire. The coaxial wire is wound around the ferrite core about once to three times. A high frequency interrupting part is provided at the front side of a connecter of a receiver connected to the other terminal of the coaxial wire. The high frequency interrupting part is for interrupting the high-frequency current from the coaxial wire.

Note that the high frequency interrupting part is a second ferrite core that has high impedance against a high-frequency wave. The above-mentioned coaxial wire passes through the inside of, or is wound around, the second ferrite core. Further, on the assumption that the frequency to be received has a wavelength of λ, the antenna element is λ/4 in length and the length from the junction of the coaxial wire to the ferrite core is λ/4.

The cobra antenna of the present invention can prevent the high-frequency wave picked up by the coaxial wire from entering the receiver by including, in front of the connector of the receiver, the second ferrite core that has high impedance against a high-frequency wave.

Effects of the Invention

According to the present invention, the length of the part of the coaxial wire except the antenna wire can freely be determined. This reduces the limitation on the placement of the antenna. Thus, the cobra antenna according to the present invention can fully exert the performance as an antenna regardless of the equipment to be connected to the antenna, and regardless of the length of the coaxial wire of the antenna.

MODE FOR CARRYING OUT THE INVENTION

An exemplary embodiment of the present invention (hereinafter, sometimes referred to as the present example) will be described below based on FIGS. 1 to 4, and described in the following order.

1. Description of the basic structure and the basic principle of a cobra antenna
2. The structure and the characteristics of the cobra antenna of the exemplary embodiment of the present invention
3. The field test performed using the cobra antenna of the exemplary embodiment of the present invention <Description of the Basic Structure and the Basic Principle of a Cobra Antenna>

Figure 5:
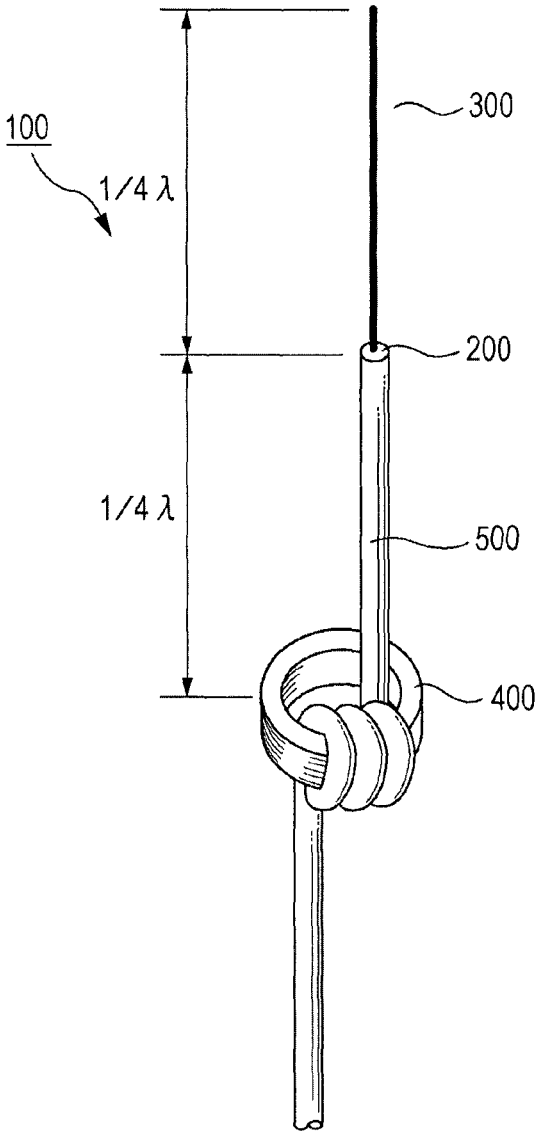
FIG. 5 is a view for describing a conventional cobra antenna.

FIG. 1A shows the same cobra antenna as the conventional cobra antenna described in FIG. 5. FIG. 1B shows the cobra antenna of the present example. First, the commonalities between FIGS. 1A and 1B will be described.

Each of cobra antennas 10 shown in FIGS. 1A and 1B includes an antenna element 2, a junction 3, a coaxial wire 5, and a ferrite core 4. The length of the antenna element 2 is λ/4 on the assumption that the radio wave to be received has a wavelength of λ. The junction 3 is a feeding point. The length of the coaxial wire from the junction 3 to the ferrite core 4 is λ/4, which is the same as the length of the antenna element 2.

An end of the coaxial wire 5 is connected to the antenna element 2 through the junction 3. Further, the coaxial wire 5 is wound around the ferrite core 4 about once to three times. The other end of the coaxial wire 5 is connected to a connector 6 of a receiver 8. In this case, a connector that has a low loss of the high-frequency signal is preferably selected as the connector 6. At the antenna element 2, an outer sheath (protective coating) 5*a* and a shield wire (external conductor) 5*b* of the coaxial wire 5 are removed.

At the junction 3, the outer sheath 5*a* and the shield wire 5*b* of the coaxial wire 5 are removed, and a core material 5*c* (inductor) is exposed. A core wire 5*d* of the coaxial wire 5 is connected to a core wire of the antenna element 2 by means of, for example, soldering. The junction 3 is molded and formed on a substrate 7. The junction 3 is a feeding point Fp of the cobra antenna 10.

With this configuration, the coaxial wire 5 from the junction 3 (the feeding point) to the ferrite core 4 (λ/4 in length) and the antenna element 2 (λ/4 in length) form a dipole antenna of λ/2.

<The Structure and the Characteristics of the Antenna of the Exemplary Embodiment of the Present Invention>

As described above, the commonalities between the cobra antennas shown in FIGS. 1A and 1B have been described. However, the cobra antenna of the present example shown in FIG. 1B differs from the conventional cobra antenna shown in FIG. 1A in that the cobra antenna of the present invention is provided with a second ferrite core 4*a* in front of the connector 6 of the receiver 8.

Hereinafter, the conventional cobra antenna shown in FIG. 1A will be referred to as a cobra antenna (one-core product) and the cobra antenna of the present invention will be referred to as a cobra antenna (two-core product).

In the conventional cobra antenna (one-core product), as already described, a high-frequency coupling occurs between the coaxial wire 5 from the ferrite core 4 to the junction 3 and the coaxial wire 5 from the ferrite core 4 to the connector 6. This degrades the performance of the antenna. Because the degrading depends on the length to the coaxial wire 5 from the ferrite core 4 to the connector 6, the length of the part becomes a limitation when this type of cobra antenna is used as a car-mounted antenna.

In the cobra antenna (two-core product) of the present example shown in FIG. 1B, the second ferrite core 4*a* is provided at a position near the receiver 8. Because the ferrite core 4*a* has high impedance against a high-frequency wave, the high-frequency current leaking from the antenna is not propagated to the receiver side.

FIG. 2A and Table 1 are the graphs showing the peak gains of the vertical polarization (V) and of the horizontal polarization (H) of the conventional cobra antenna (one-core product) shown in FIG. 1A. The horizontal axis of FIG. 2A denotes the frequencies (MHz) and the vertical axis denotes the peak gains (dBd).

The frequencies to be measured are set at FM/VHF bands (70 MHz to 220 MHz). The vertical polarization (V) is denoted by a dash line. The horizontal polarization (H) is denoted by a solid line.

Table 1 shows the value of the peak gain of the vertical polarization (V) and the value of the peak gain of the horizontal polarization (H) at each measurement point in the graph shown in FIG. 2A. Note that, in Table 1, only the measured values of the frequencies from 76 MHz to 107 MHz are shown from among the frequencies shown in the horizontal axis of FIG. 2A.

As shown in FIG. 2A and Table 1, the peak gain of the vertical polarization (V) becomes −11.50 dBd at 86 MHz and −10.85 dBd at 95 MHz. The peak gain of the horizontal polarization (H) becomes −16.70 dBd at 86 MHz and −14.85 dBd at 95 MHz. In other words, it is found that the conventional cobra antenna (one-core product) also can receive both of the vertical polarization and the horizontal polarization in the FM/VHF bands.

TABLE 1

| | Vertical polarization | | | | | | | |
|---|---|---|---|---|---|---|---|---|
| Freq[MHz] | 76 | 78.5 | 81 | 83.5 | 86 | 95 | 101 | 107 |
| Peak[dBd] | −12.04 | −12.60 | −12.81 | −12.14 | −11.50 | −10.85 | −11.87 | −12.96 |
| | Horizontal polarization | | | | | | | |
| Freq[MHz] | 76 | 78.5 | 81 | 83.5 | 86 | 95 | 101 | 107 |
| Peak[dBd] | −18.76 | −18.80 | −18.61 | −17.72 | −16.70 | −14.85 | −15.14 | −15.50 |

On the other hand, the frequency gain characteristics of the cobra antenna (two-core product) of the present example are shown in FIG. 2B and Table 2. As is obvious from FIG. 2B and Table 2, both of the vertical polarization (V) and the horizontal polarization (H) reach maximum values near 95 MHz. The vertical polarization (V) is −8.25 dBd and the horizontal polarization (H) is −13.65 dBd. In comparison with the conventional type (one-core product) shown in FIG. 2A and Table 1, the peak gains at 95 MHz become higher. The frequency-gain characteristics are obviously improved. In other words, it is found that the performance of the cobra antenna (two-core product) of the present example is superior to that of the conventional cobra antenna (one-core product).

TABLE 2

| | Vertical polarization | | | | | | | |
|---|---|---|---|---|---|---|---|---|
| Freq[MHz] | 76 | 78.5 | 81 | 83.5 | 86 | 95 | 101 | 107 |
| Peak[dBd] | −12.40 | −12.80 | −12.81 | −11.92 | −10.70 | −8.25 | −8.87 | −10.83 |
| | Horizontal polarization | | | | | | | |
| Freq[MHz] | 76 | 78.5 | 81 | 83.5 | 86 | 95 | 101 | 107 |
| Peak[dBd] | −20.31 | −20.20 | −19.96 | −18.71 | −17.30 | −13.65 | −13.67 | −14.76 |

FIGS. 2A and 2B show the minimum values at about 130 MHz. It is indicated that setting the resonance frequency at 100 MHz causes the Q factor of the antenna to become high at about 130 MHz and causes antiresonance (mismatch) so that the frequency cannot be received. Note that the resonance frequency that has been set at 100 MHz resonates with a high frequency. Specifically, the odd multiples of the resonance frequency or, namely, even the triple, or quintuple of the basic resonance wavelength can be received. As for the cobra antenna (two-core product) of the present example, the resonance can occur even when the frequency is set at 200 MHz.

<The Field Test Performed Using the Cobra Antenna of the Present Invention>

Figure 1:
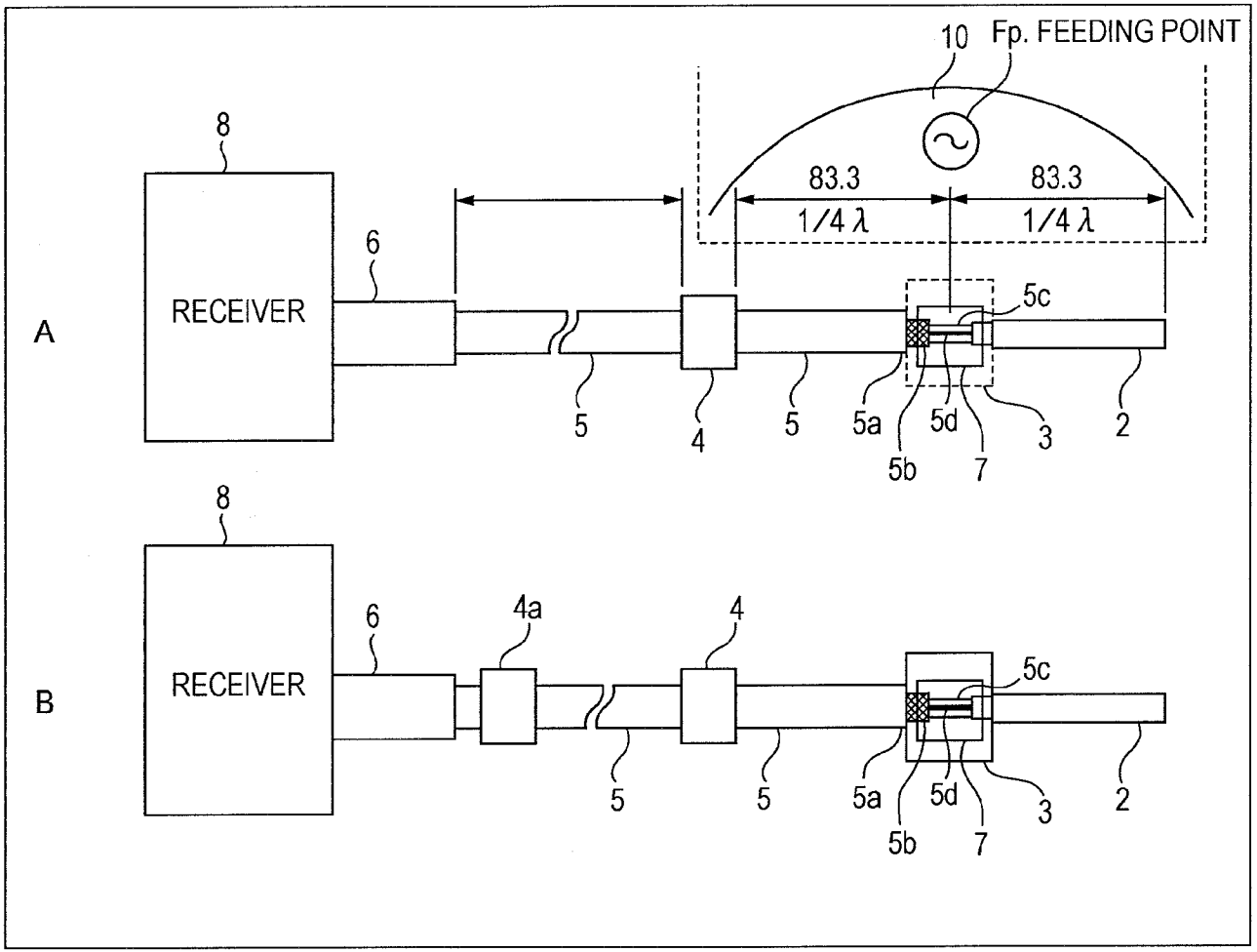
FIG. 1 is a schematic view showing the comparison between an exemplary embodiment of the cobra antenna of the present invention (B) and a conventional cobra antenna (A).
Figure 2:
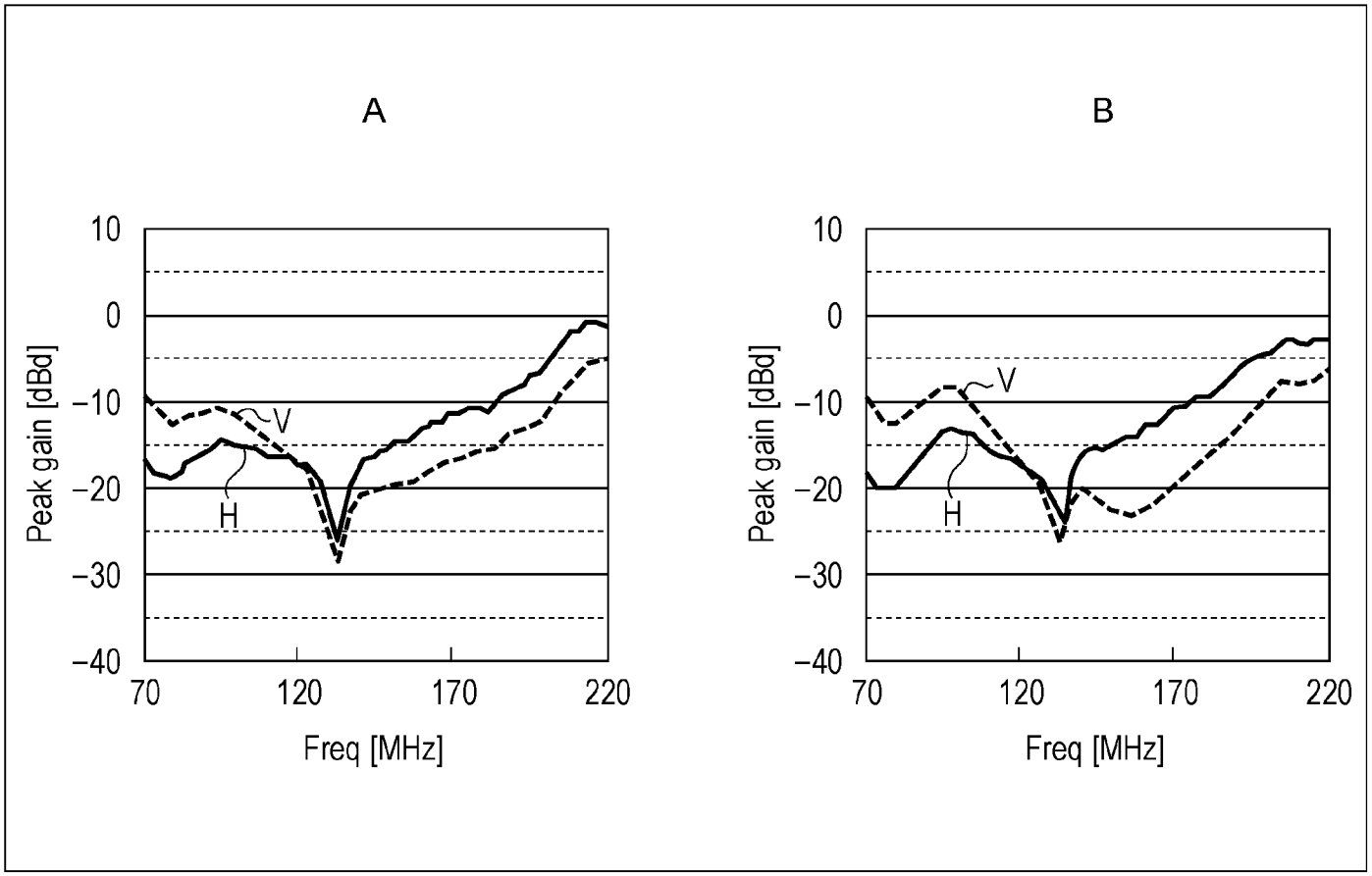
FIG. 2 is a schematic view showing the comparison between the frequencies-gain characteristics of the cobra antenna of the exemplary embodiment of the present invention (B) and the frequencies-gain characteristics of the conventional cobra antenna (A).
Figure 3:
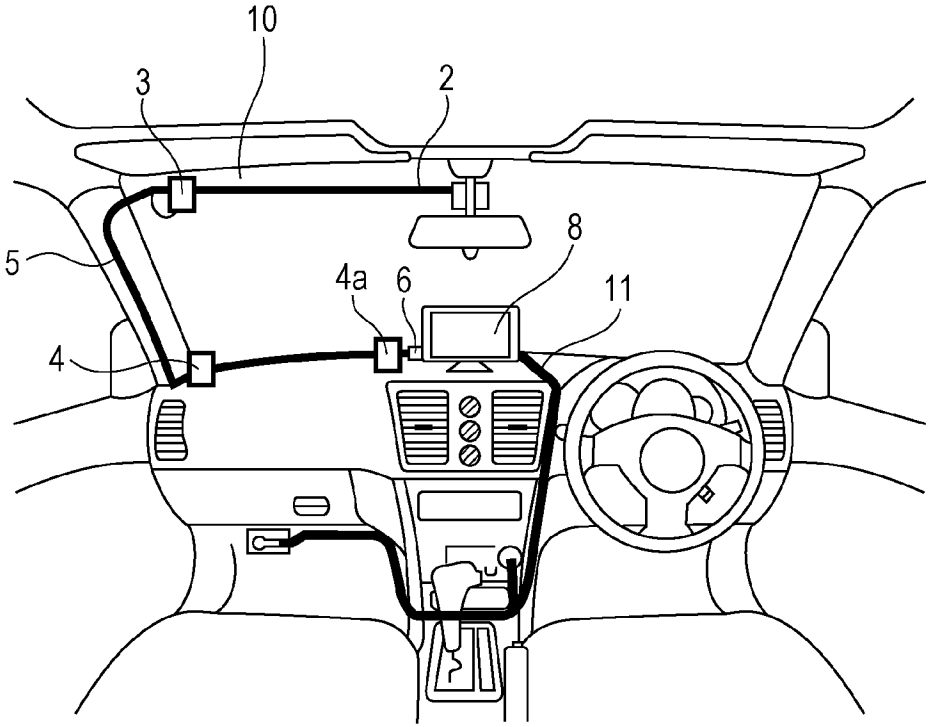
FIG. 3 is a view showing an example where the cobra antenna of the exemplary embodiment of the present invention is attached as a car-mounted antenna.

FIG. 3 is a view showing an example where the cobra antenna (two-core product) of the present invention is mounted on the car belonging to the inventor to perform a field test for the cobra antenna (two-core product). Needless to say, the conventional cobra antenna (one-core product) has also been mounted on the car to perform the same measurement for comparison.

As shown in FIG. 3, the antenna element 2 from the junction 3 of the cobra antenna 10 to the tip is horizontally attached at the windshield from the rearview mirror. The coaxial wire 5 from the junction 3 to the ferrite core 4 is longitudinally attached at the left side. This forms the cobra antenna 10 as a V-shaped antenna having the junction 3 as a center (starting point). The junction 3 is a feeding point.

In consideration of the fact that an FM band of 90 MHz has a wavelength λ of 3.33 m, in each of the cobra antenna (two-core product) of the present example and the conventional cobra antenna (one-core product), the antenna element 2 is set as 0.83 m equal to λ/4 in length, the coaxial wire 5 from the junction 3 to the ferrite core 4 is similarly set as 0.83 m equal to λ/4 in length, and then the antenna is set as λ/2 (1.66 m) in length.

The coaxial wire 5 from the ferrite core 4 to the connector 6 of the receiver 8 is horizontally routed on the dashboard of the car. Note that, in the cobra antenna (two-core product) 10 of the present example, the second ferrite core 4*a* is inserted into the front (proximity) of the connector 6 of the receiver 8.

The coaxial wire 5 can only pass through the hole of the second ferrite core 4*a*. However, the coaxial wire 5 can also be wound around the ferrite core 4*a* about once to three times and be connected to the connector 6. As described above, in the cobra antenna (two-core product) 10 of the present example, the ferrite core 4*a* is positioned in front of the connector 6. Accordingly, the receiver 8 side has high impedance against the high-frequency current picked up by the coaxial wire 5. The coaxial wire 5 connects the ferrite core 4 to the connector 6. Thus, even though the coaxial wire 5 from the first ferrite core 4 to the connector 6 picks up the leaked high-frequency current, the leaked high-frequency current does not adversely affect the receiver 8 side.

As shown in FIG. 3, the cobra antenna (two-core product) of the present example and the conventional cobra antenna (one-core product) have separately been mounted on the car to perform a field test.

Figure 4:
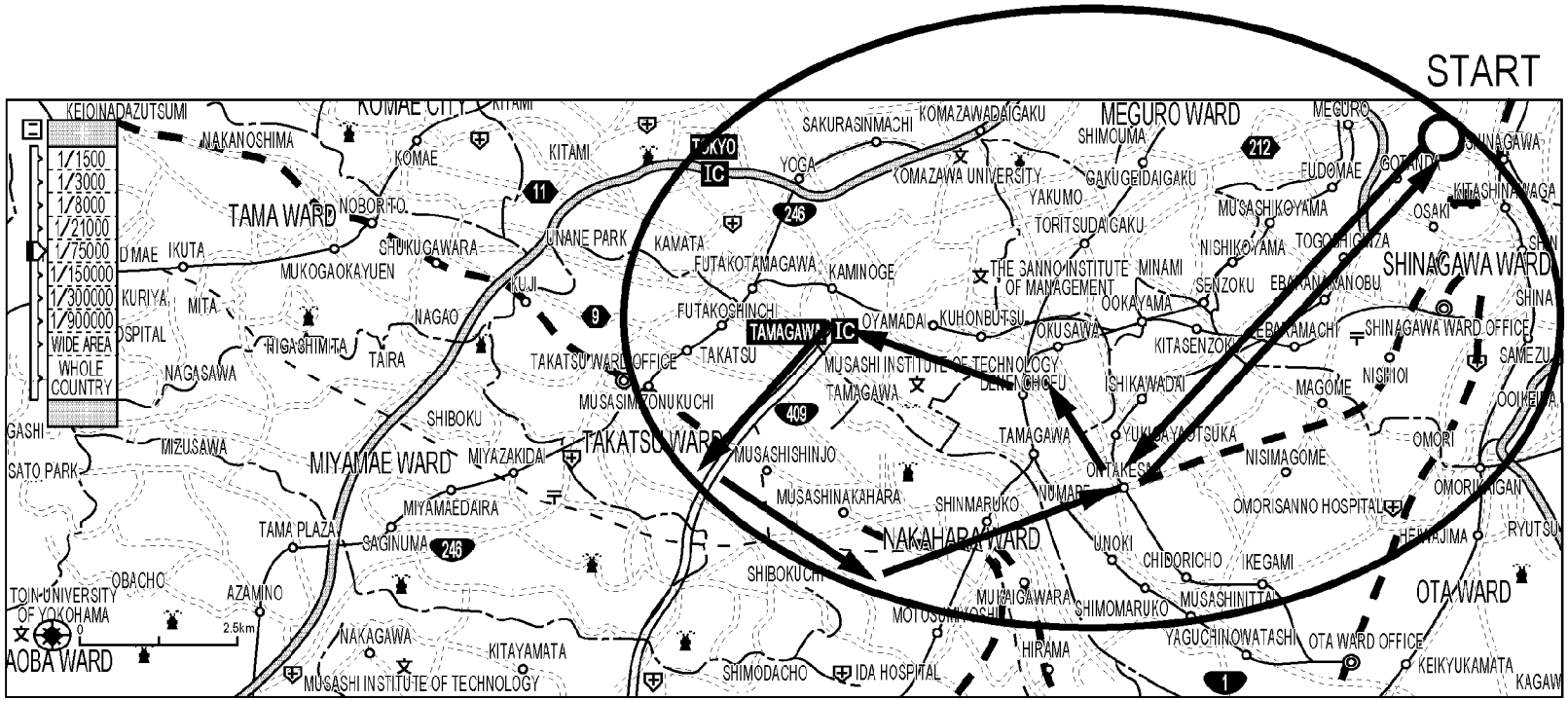
FIG. 4 is a view showing the route used for the field test for a car on which the cobra antenna of the exemplary embodiment of the present invention is mounted as a car-mounted antenna.

FIG. 4 is a view showing the course for the test of each reception performance of the cobra antennas that have actually been mounted on the inventor's car by the inventor. The type of the car was Toyota Carolla (registered trademark). The equipment used as the receiver 8 was a personal navigation device (PND) manufactured by SANYO Electric Co., Ltd. (GORILLA NV-SD750FT) (GORILLA is a registered trademark). The received frequency was 81.9 MHz from VICS Yokohama and the output was 5 kW.

As for the sample of the cobra antenna 10, the distance from the junction 3 to the tip of the antenna element 2 was 83 cm and the distance from the junction 3 to the ferrite core 4 was also 83 cm. Further, in the test, the second ferrite core 4*a* was provided about 5 cm away from a plug to be inserted into the connector 6 of the receiver 8. However, the distance can be determined as needed.

As shown in FIG. 4, in the field test, the conventional cobra antenna (one-core product) was first mounted on the car and the car run on Nakahara-Kaido way shown in the drawing to append the VICS updated every five minutes in the running section. Next, the cobra antenna (two-core product) of the present example was mounted on the car and the car run on the same course to append the VICS every five minutes in the running section in the same manner.

The test results are the following.

the conventional cobra antenna (one-core product): 6/11 times, 54% reception rate the cobra antenna (two-core product) of the present example: 12/14 times, 78% reception rate As is obvious from the results, it can be confirmed that the cobra antenna (two-core product) of the present invention can almost certainly update the data every five minutes in comparison with the conventional type (one-core product).

As described above, the cobra antenna (two-core product) as the exemplary embodiment of the present invention has been described in comparison with the conventional cobra antenna (one-core product). In the above-mentioned description, the antenna using a coaxial wire (wire rod) has been described. However, an antenna constituted of a substrate, a film, and a metal wire can be used for the antenna element part to exert the same effect. Further, needless to say, the present invention can be used for the equipment in a room except a car although the present example has been described as an example that has been mounted on the car.

REFERENCE SIGNS LIST

10, 100 Cobra antenna
2, 300 Antenna element
3 Junction
4, 4*a*, 400 Ferrite core
5, 500 Coaxial wire
5*a* Protective coating
5*b* Shield wire
5*c* Core material
5*d* Core wire
Fp, 200 Feeding point
6 Connector
7 Substrate
8 Receiver

The invention claimed is:

1. An antenna, comprising:

a junction constituting a feeding point, wherein the junction is present on a substrate;

an antenna element electrically coupled to a first terminal of the junction and having a length corresponding to a frequency of a broadcast wave to be received;

a coaxial wire with a first end electrically coupled to a second terminal of the junction;

a first ferrite core provided on the coaxial wire at a position, where a length of the coaxial wire determined from the second terminal of the junction is equal to a length of the antenna element up to the first terminal of the junction, wherein the coaxial wire is wound around the first ferrite core; and a high frequency interrupting part, provided at a front of a receiver to which a second end of the coaxial wire is coupled to interrupt a high-frequency current from the coaxial wire.

2. The antenna according to claim 1, wherein the high frequency interrupting part has a high impedance against a high-frequency wave and the high frequency interrupting part is a second ferrite core through which the coaxial wire passes or around which the coaxial wire is wound.

3. The antenna according to claim 1, wherein the length of the antenna element and a length of the coaxial wire from the second terminal of the junction to the first ferrite core is one fourth of a wavelength of a frequency received of the broadcast wave.

4. The antenna according to claim 1, wherein the antenna element coupled to the first terminal of the junction is constituted of a core part that includes a core wire, and wherein the core wire of the antenna element is electrically coupled to the core wire of the coaxial wire at the junction.

* * * * *